US006882822B2

(12) United States Patent
Gomi et al.

(10) Patent No.: US 6,882,822 B2
(45) Date of Patent: Apr. 19, 2005

(54) PLATEN COVER OPEN/CLOSE MECHANISM FOR IMAGE FORMING APPARATUS

(75) Inventors: Masayuki Gomi, Kashihara (JP); Takashi Kubo, Soraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/414,142

(22) Filed: Apr. 15, 2003

(65) Prior Publication Data

US 2003/0198493 A1 Oct. 23, 2003

(30) Foreign Application Priority Data

Apr. 22, 2002 (JP) ..... P2002-119533

(51) Int. Cl.[7] ..... G03G 15/00
(52) U.S. Cl. ..... 399/380; 399/377
(58) Field of Search ..... 399/380, 377, 399/362, 361; 355/230, 231, 75

(56) References Cited

U.S. PATENT DOCUMENTS 2,282,768 A * 5/1942 Pickett ..... 355/25
3,726,589 A * 4/1973 Difulvio ..... 355/64
5,541,712 A * 7/1996 Fujitaka et al. ..... 399/380
6,113,346 A * 9/2000 Blake et al. ..... 414/811
6,726,433 B1 * 4/2004 Blake et al. ..... 414/411

FOREIGN PATENT DOCUMENTS

| | | |
|---|---|---|
| JP | 61-107336 | 5/1986 |
| JP | 62-211633 | 9/1987 |
| JP | 63-164742 | 10/1988 |
| JP | 1-128234 | 9/1989 |

* cited by examiner

*Primary Examiner*—Anthony H. Nguyen
(74) *Attorney, Agent, or Firm*—Edwards & Angell, LLP; David G. Conlin; George W. Hartnell, III

(57) ABSTRACT

The invention provides a platen cover open/close mechanism for an image scanning device including platen glass, a platen cover for pressing an original against the platen glass and an optical scanning unit for scanning an image on the original. In one form of the invention, the platen cover is formed as a single piece and always held parallel to the platen glass. In another form of the invention, the platen cover is divided into at least two portions, of which one portion is always held parallel to the platen glass.

5 Claims, 16 Drawing Sheets

PLATEN COVER OPEN/CLOSE MECHANISM FOR IMAGE FORMING APPARATUS

BACKGROUND OF THE INVENTION

1. Field of the Invention

The present invention relates to a platen cover open/close mechanism for an image scanning device of an image forming apparatus, such as an image scanner or an electrophotographic copier.

2. Description of the Related Art

Conventionally, an image scanning device incorporated in an image forming apparatus like various types of copiers is constructed as shown in FIG. 1. Specifically, the image scanning device is provided with a platen cover 1 for holding an original 4 placed at a specific position on platen glass 3 which serves as an image scanning surface by pressing the original 4 in position in a stable manner. A rear end of the platen cover 1 is usually hinged to the image forming apparatus so that the platen cover 1 can be swung up and down about its hinged end by manually lifting it by a grip 2 provided on its front edge. In FIG. 1, the reference numeral 5 designates an operator panel.

Since the platen glass 3 is usually provided at an uppermost part of the image scanning device, its location often causes inconvenience to a little child or a physically handicapped person confined to a wheelchair when such a person attempts to move the platen cover 1 up and down. In fact, it is occasionally difficult, or even impossible, for them to reach the platen cover 1 provided at the uppermost part for opening and closing it.

Even if they could manage to open and close the platen cover 1 one way or another, closing the platen cover 1 after setting the original 4 in position might produce a wind pressure directed in a particular direction. Consequently, the original 4 once placed in a proper position might be displaced. Particularly when the original 4 is a small-sized sheet, such as a postcard, it can easily be displaced by the influence of the wind pressure, and it is not easy for little children and handicapped persons to make sure that the original 4 is kept in the correct position after closing the platen cover 1.

To overcome the aforementioned problem, Japanese Laid-open Patent Publication No. S62-211633 discloses an arrangement in which a platen cover is made bendable by means of a hinge joining its two divided portions. The hinge extends obliquely to a reference line with which each original should be aligned. In this structure, an operator can easily open, or lift up, one portion of the platen cover and visually check that the original is in proper alignment with the reference line, even when the original is small-sized.

On the other hand, Japanese Laid-open Utility Model Publication No. S63-164742 discloses an arrangement in which an original holding sheet is provided on a bottom surface of a platen cover and, when the platen cover is closed, a squeezer presses the original holding sheet against an original to prevent its displacement. Also, Japanese Laid-open Utility Model Publication No. H1-128234 discloses an arrangement in which a platen cover is opened and closed by an electric motor to provide improved operability.

In any of the aforementioned examples of the prior art, the platen cover is opened and closed by swinging it up and down about its rear end. In these prior art arrangements, opening and closing the platen cover forcibly produces variations in wind pressure near the platen glass, and it is likely that the original is displaced from its correct position due to the influence of the wind pressure. Particularly when the original is small-sized or thin, it can be moved quite easily from the set position by a flow of air. In this circumstance, it has been needed to provide means for preventing this kind of displacement of the original.

SUMMARY OF THE INVENTION

In light of the foregoing, it is an object of the invention to provide a platen cover open/close mechanism for an image scanning device in which an original is less affected, or displaced, by a wind pressure when a platen cover is closed, allowing easy operation from lower positions even by little children or handicapped persons (particularly those confined to wheelchairs).

In one aspect of the invention, a platen cover open/close mechanism for an image scanning device includes a platen cover for pressing an original placed on platen glass thereagainst, a platen cover support supporting the platen cover in such a manner that the platen cover can be lowered onto and lifted up from the platen glass, and a cover lowering mechanism for lowering the platen cover while holding it in a horizontal position with the aid of the platen cover support.

As stated earlier, the image scanning device of the prior art is constructed such that the platen cover is opened and closed by lifting its front end up an down about its hinged rear end. In this conventional construction, a flow of air directed from the rear to the front of the platen glass is produced and a resultant wind pressure often causes a displacement of the original placed on the platen glass when the platen cover is closed.

In the aforementioned construction of the present invention, the platen cover is held parallel to the platen glass when it is closed and, as a consequence, the flow of air is oriented in all directions without being concentrated in one direction. This would help prevent displacement of the original set on the platen glass.

The platen cover of the conventional image scanning device provided at the top of the platen glass should be swung up over a large stroke from its closed position to its open position when placing an original on the platen glass, so that the conventional construction poses difficulty in operation to little children and handicapped persons (particularly those confined to wheelchairs). The construction of the invention offers improved operability from this point of view as well, because an operator needs to just reach the height of the platen cover at its vertically raised position when loading the original.

In another aspect of the invention, a platen cover open/close mechanism for an image scanning device includes a platen cover for pressing an original placed on platen glass thereagainst, the platen cover being divided into at least two portions, a platen cover support supporting at least one of the divided portions of the platen cover in such a manner that the platen cover can be lowered onto and lifted up from the platen glass, and a cover up/down mechanism for lowering and lifting up the platen cover while holding at least one of the divided portions of the platen cover parallel to the platen glass with the aid of the platen cover support.

In this construction, at least one of the divided portions of the platen cover is lowered and lifted up in a position parallel to the platen glass and the other divided portion of the platen cover descends and ascends following the portion held parallel to the platen glass. This serves to simplify mechanical construction for lowering and lifting up the platen cover.

In still another aspect of the invention, a platen cover open/close mechanism for an image scanning device includes a platen cover for pressing an original placed on platen glass thereagainst, the platen cover being divided into at least two portions, a platen cover support supporting at least one of the divided portions of the platen cover in such a manner that the platen cover can be lowered onto and lifted up from the platen glass, a joint interconnecting the divided portions of the platen cover in a stepped form while holding them parallel to the platen glass, and a cover lowering mechanism for lowering the platen cover while keeping its divided portions in the stepped form and parallel to the platen glass down to a position where original holding surfaces of the individual portions of the platen cover become flush with each other and press the original against the platen glass.

In this construction, the divided portions of the platen cover are kept in the stepped form and parallel to the platen glass as they are lowered together. This serves to produce a smooth flow of air and prevent displacement of the original. In addition, since the original is first pressed by the first descending portion of the platen cover and finally pressed by all the portions of the platen cover which have become flush with each other, the original can be held in position in a stable fashion.

These and other objects, features and advantages of the invention will become more apparent upon reading the following detailed description along with the accompanying drawings.

DETAILED DESCRIPTION OF THE PREFERRED EMBODIMENTS OF THE INVENTION

Platen cover open/close mechanisms for image scanning devices according to specific embodiments of the invention are now described in detail with reference to the appended drawings.

First Embodiment

Figure 1:
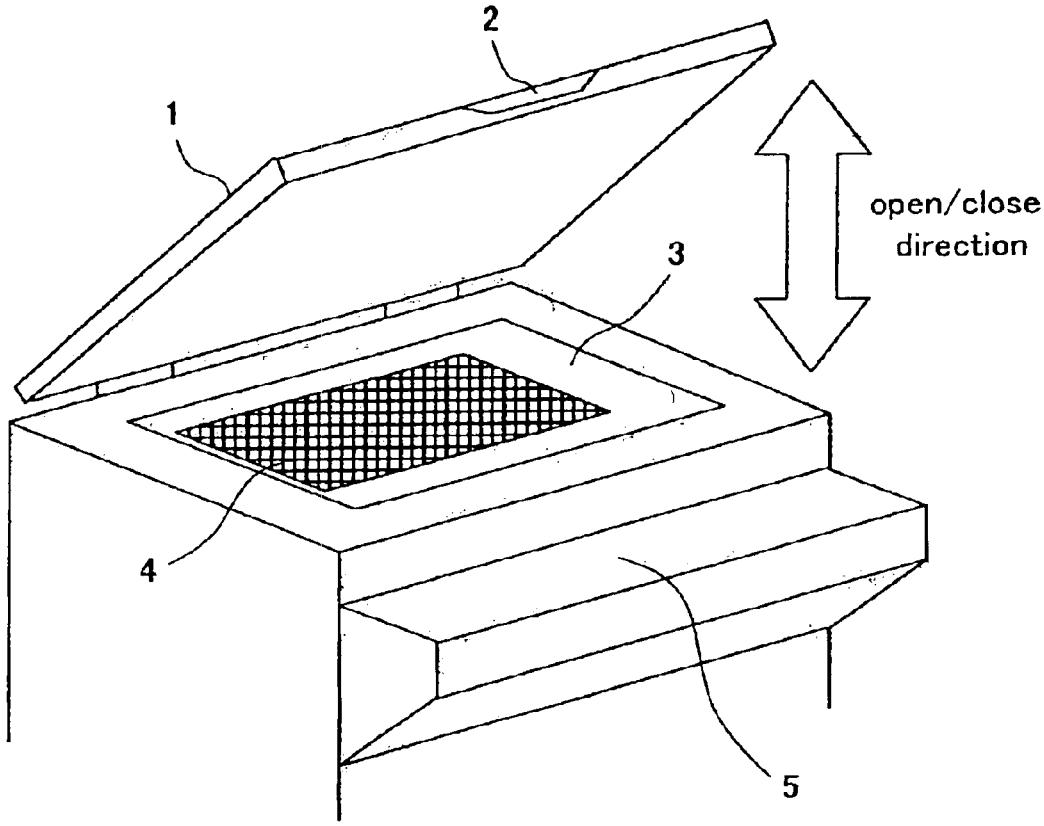
FIG. 1 is a perspective view mainly showing a conventional platen cover unit of an image forming apparatus.
Figure 2:
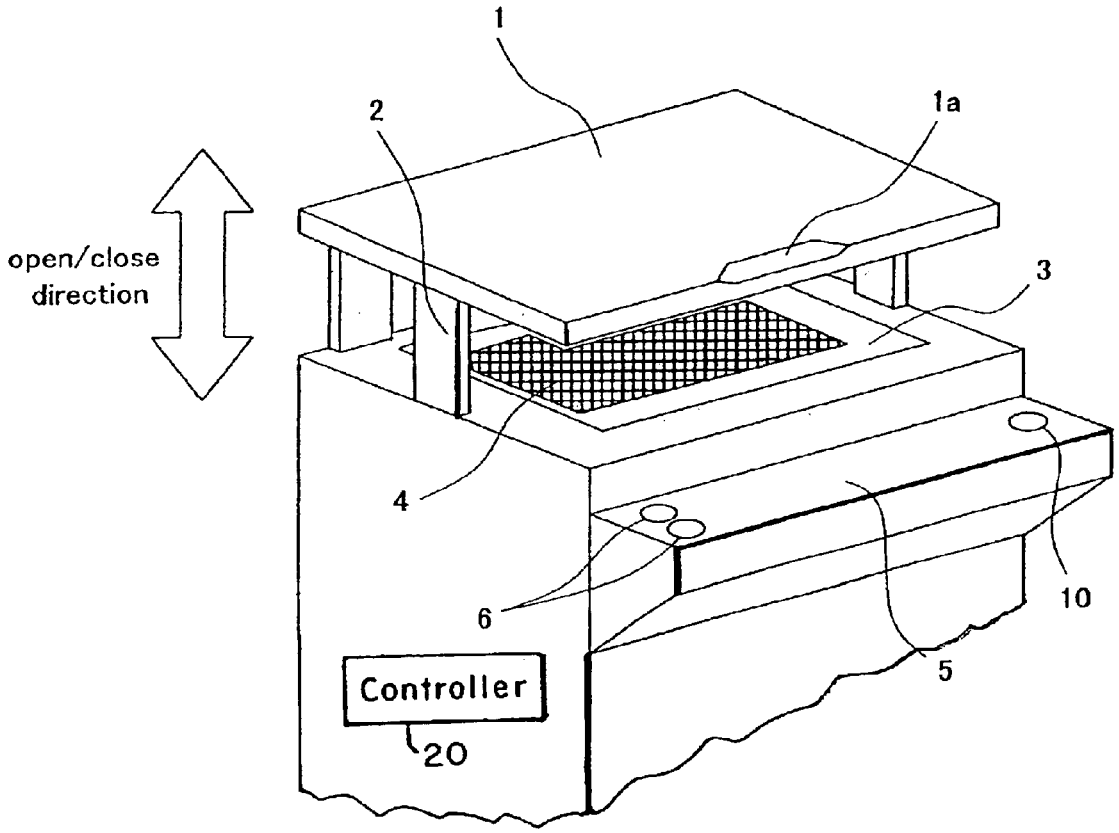
FIG. 2 is a perspective view mainly showing a platen cover unit according to a first embodiment of the invention.
Figure 3:
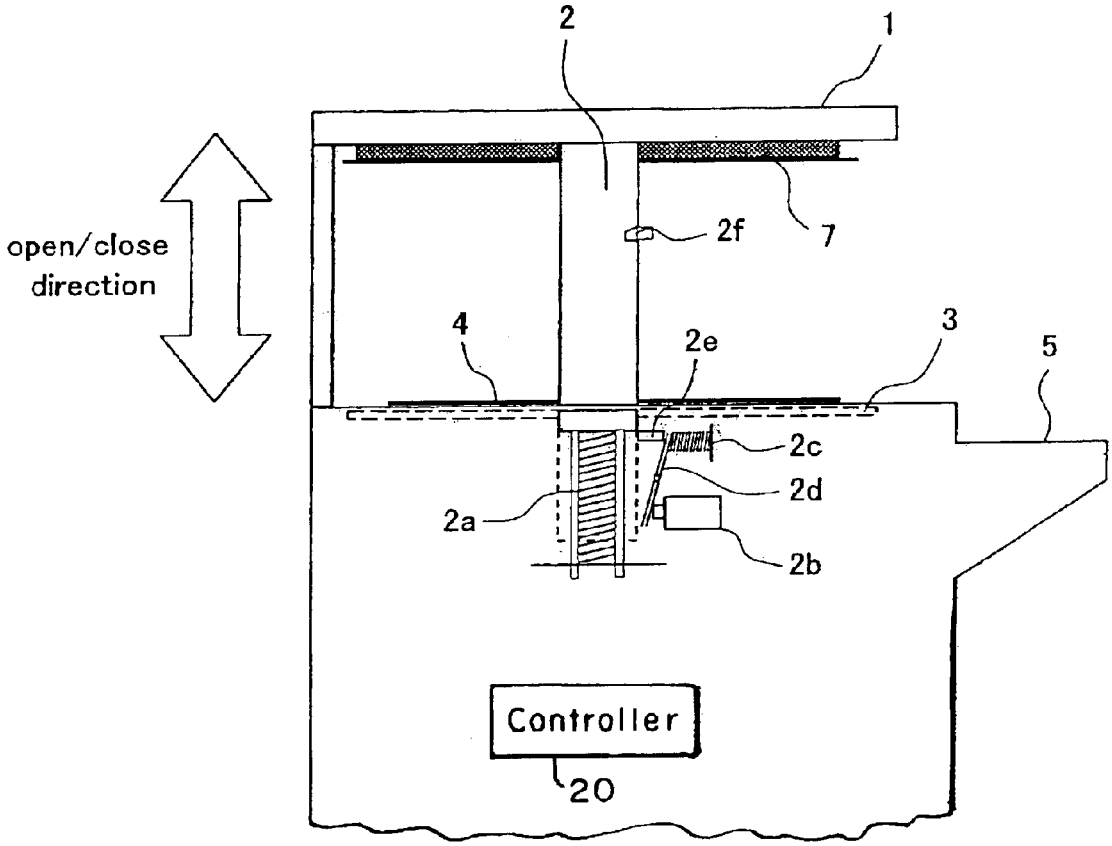
FIG. 3 is a side view mainly showing a manual platen cover lift mechanism of the platen cover unit of FIG. 2.

FIG. 2 is a perspective view mainly showing a platen cover unit of an image scanning device according to a first embodiment of the invention, and FIG. 3 is a side view mainly showing the platen cover unit of FIG. 2. The platen cover unit of this embodiment is constructed such that its horizontal platen cover 1 can be manually moved downward. In FIGS. 2–3, the reference numeral 1*a* designates a grip, the reference numeral 2 designates platen cover arms, the reference numeral 3 designates platen glass serving as an original loading plate, the reference numeral 4 designates an original, the reference numeral 5 designates an operator panel, and the reference numeral 7 designates a mat attached to a bottom surface of the horizontal platen cover 1 for pressing the original 4.

More specifically, the platen cover arms 2 are fixed to both left and right ends and a rear end of the horizontal platen cover 1 and slidably fitted in vertical guide holes formed in a housing of the image scanning device. These guide holes vertically guide the horizontal platen cover 1 while holding it in a horizontal position, that is, parallel to the platen glass 3 which serves as the original loading plate. As shown in FIG. 3, there is provided a cover lifting spring 2*a* at the bottom of one platen cover arm 2. The cover lifting spring 2*a* continuously exerts an upward pushing force on the platen cover arm 2.

The cover lifting spring 2*a* is associated with a solenoid 2*b* provided close to the guide hole, a release spring 2*c*, a lever 2*d* and a stopper 2*e* attached to one end of the lever 2*d*. Moving in interlocked action with the lever 2*d*, the stopper 2*e* can fit into and retract from a cutout 2*f* formed in the platen cover arm 2.

In this construction, if an operator moves the horizontal platen cover 1 downward after loading the original 4 at a specific position on the platen glass 3 and the horizontal platen cover 1 descends down to its lower limit position, the stopper 2*e* fits into the cutout 2*f* formed in the pertinent platen cover arm 2 and the horizontal platen cover 1 is locked to its lower limit position, where the horizontal platen cover 1 presses the original 4 against the platen glass 3 and the image scanning device scans an image on the original 4.

Upon completion of this image scanning operation, a plunger of the solenoid 2*b* sticks out, causing the lever 2*d* to turn in a clockwise direction as illustrated. As a result, the lever 2*d* compresses the release spring 2*c* and the stopper 2*e* comes off the cutout 2*f*. Since the horizontal platen cover 1 is set free at this point, it ascends up to its open position due to the upward pushing force exerted by the cover lifting spring 2*a*.

The aforementioned construction of the embodiment allows the operator to easily open and close the horizontal platen cover 1. Furthermore, since the horizontal platen cover 1 is held in a horizontal position as it is pushed down to the platen glass 3, the horizontal platen cover 1 produces a stable wind pressure uniformly exerted from above on the entire surface of the original 4 without causing variations in the wind pressure. This serves to prevent displacement of the original 4.

Although the platen cover unit of the embodiment has been described as being provided with the cover lifting spring 2*a* and its associated elements 2*b*-2*f* at one of the platen cover arms 2, they may be provided at two (e.g., left and right) or more platen cover arms 2.

Second Embodiment

Figure 4:
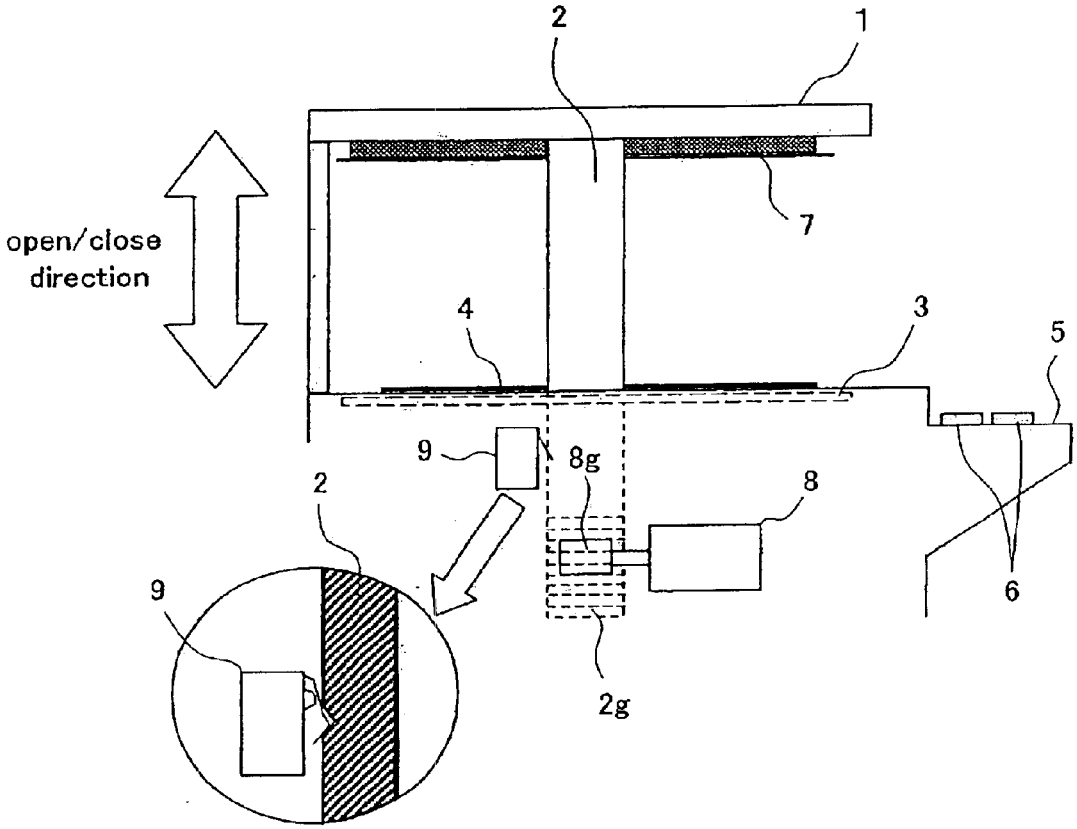
FIG. 4 is a side view mainly showing a platen cover unit having an automatic platen cover up/down mechanism according to a second embodiment of the invention.

FIG. 4 is a side view mainly showing a platen cover unit according to a second embodiment of the invention, in which elements identical or similar to those shown in FIGS. 2–3 are designated by the same reference numerals. The platen cover unit of this embodiment is constructed such that its horizontal platen cover 1 can be moved automatically or semiautomatically. In this embodiment, the platen cover arms 2 are supported by a housing of the image scanning device in a similar fashion as illustrated in FIG. 3. As shown in FIG. 4, there are provided in the housing of the image scanning device a rack 2*g* formed at (or attached to) the bottom of one platen cover arm 2, a pinion 8*g* attached to an output shaft of a platen cover up/down motor (prime mover) 8 and engaged with the rack 2*g*, and a cover switch (sensor) 9 for detecting the position of the horizontal platen cover 1. When the horizontal platen cover 1 is in its open position, a contact lever of the cover switch 9 is fitted in a recess formed in the pertinent platen cover arm 2 as illustrated.

In this construction, when the horizontal platen cover 1 is pushed down a little with an original 4 placed at a specific position on the platen glass 3, the cover switch 9 detects that the operator has initiated an action to close the horizontal platen cover 1 and outputs a sensing signal to a controller 20. This sensing signal causes the controller 20 to drive the platen cover up/down motor 8 in a controlled manner according to a preset control program. Specifically, the platen cover up/down motor 8 is first driven to automatically lower the horizontal platen cover 1, and when the image scanning device has completed scanning of an image on the original 4, the platen cover up/down motor 8 is reversely driven to automatically lift the horizontal platen cover 1 up to its open position.

In the aforementioned construction, the horizontal platen cover 1 produces a stable wind pressure uniformly exerted from above on the entire surface of the original 4 without causing variations in the wind pressure, so that this embodiment also serves to prevent displacement of the original 4.

In one alternative, the platen cover unit of this embodiment may be constructed in such a manner that its controller 20 is activated by pressing a START button 10 (refer to FIG. 2) after placing the original 4 on the platen glass 3 and making various settings for copying so that the platen cover up/down motor 8 is driven in a controlled manner to automatically lower the horizontal platen cover 1 and automatically lift up the horizontal platen cover 1 upon completion of scanning of the original 4. In this variation of the embodiment, there is no need to provide the cover switch 9.

In another alternative, the platen cover unit of the embodiment may be constructed in such a manner that the platen cover up/down motor 8 is driven by pressing a DOWN button of a platen cover up/down control 6 to automatically lower the horizontal platen cover 1, and when scanning of the original 4 has finished, the platen cover up/down motor 8 is reversely driven by pressing an UP button of the platen cover up/down control 6 to automatically lift up the horizontal platen cover 1.

In this construction, it is preferable that the horizontal platen cover 1 be automatically lowered with adjustable strengths to suit the thickness of the original 4. If the original 4 is a book, for example, the operator should preferably be allowed to set the type of the original 4 so that the horizontal platen cover 1 would descend with a proper strength (downward pushing force). This capability would relieve the operator of the need to manually hold the book or perform other awkward action when copying it, thereby contributing to an improvement in operational ease.

In still another alternative, the platen cover unit of the embodiment may be constructed in such a manner that closing and opening action of horizontal platen cover 1 is initiated and performed in a fully automatic fashion by a single press of a platen cover up/down button provided on the operator panel 5. More specifically, when the controller 20 is activated by pressing the platen cover up/down button, the horizontal platen cover 1 is automatically lowered, the image scanning device scans the image on the original 4, and when scanning of the original 4 has finished, the platen cover up/down motor 8 is reversely driven to automatically lift up the horizontal platen cover 1 in this variation of the embodiment.

Although the platen cover unit of the embodiment has been described as being provided with the platen cover up/down motor 8 and its associated elements 2*g*, 8*g*, 9 at one of the platen cover arms 2, they may be provided at two (e.g., left and right) or more platen cover arms 2.

Third Embodiment

Figure 5:
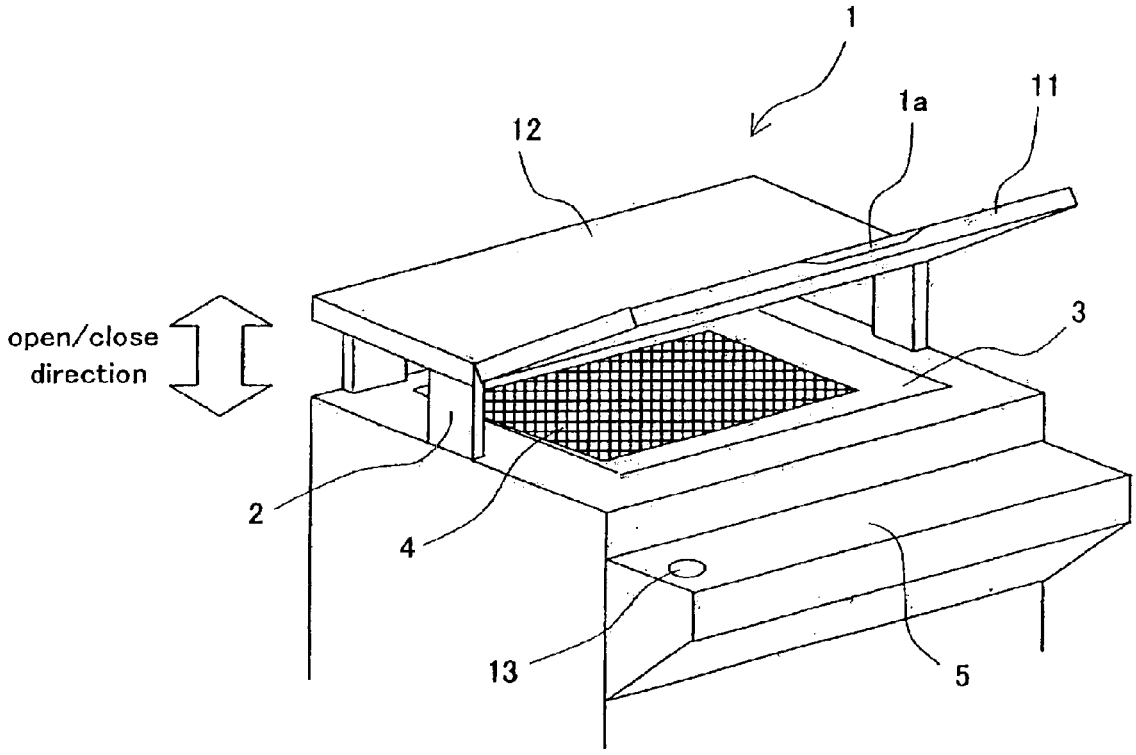
FIG. 5 is a perspective view mainly showing a platen cover unit according to a third embodiment of the invention.
Figure 6:
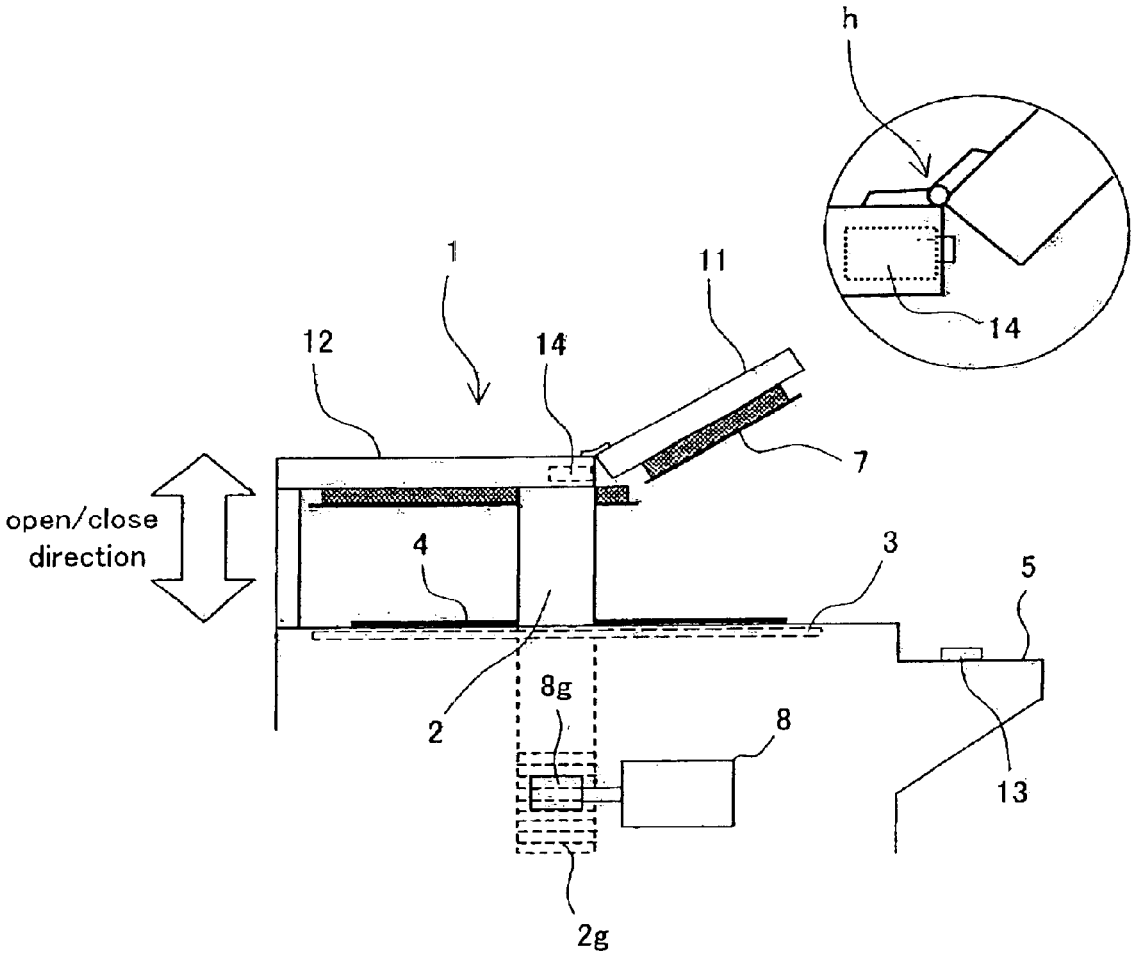
FIG. 6 is a side view mainly showing an automatic platen cover up/down mechanism of the platen cover unit of FIG. 5.

FIG. 5 is a perspective view mainly showing a platen cover unit of an image scanning device employing a two-part platen cover structure according to a third embodiment of the invention, in which elements identical or similar to those shown in FIGS. 2–3 are designated by the same reference numerals. A two-part platen cover 1 is formed of a rear cover portion 12 and a front cover portion 11 swingably attached to a front edge of the rear cover portion 12 by means of a hinge h. The rear cover portion 12 is fixed to platen cover arms 2 and held in a horizontal position, parallel to the platen glass 3, while the front cover portion 11 is made swingable about the front edge of the rear cover portion 12 as illustrated. The platen cover unit of this embodiment may employ the same support mechanism as depicted in FIG. 3, for example, for supporting the platen cover arms 2.

In this construction, the operator places an original 4 on the platen glass 3 and swings down the front cover portion 11 so that its original holding surface becomes flush with that of the rear cover portion 12 in a horizontal plane. When the front and rear cover portions 11, 12 have been manually pushed down together to the platen glass 3, the image scanning device scans an image on the original 4. Upon completion of the image scanning operation, the two-part platen cover 1 is lifted up to its open position due to the upward pushing force exerted by the cover lifting spring 2*a*.

As the two-part platen cover 1 can be easily swung up in the aforementioned two-part platen cover structure of the embodiment, it is easier to load and replace the original 4. Furthermore, since the front and rear cover portions 11, 12 are lowered together, with their original holding surfaces made flush with each other in a horizontal plane, the two-part platen cover 1 produces no variations in wind pressure during its descent, thereby preventing displacement of the original 4 in the same fashion as in the foregoing embodiments.

In one varied form of this embodiment, the platen cover unit having the aforementioned two-part platen cover 1 may employ the same support mechanism for supporting the two-part platen cover 1 as depicted in FIG. 4 so that its closing and opening action is performed automatically. In this variation of the embodiment, a controller 20 is activated when the operator closes the front cover portion 11 with the original 4 placed on the platen glass 3 and presses a platen cover up/down button 13, for example. As a result, the platen cover up/down motor 8 is driven in a controlled manner to automatically lower the front cover portion 11 and the rear cover portion 12 together. If the operator re-presses the platen cover up/down button 13 upon completion of scanning of the original 4, the front and rear cover portions 11, 12 are automatically lifted up.

In this variation, it is preferable that the two-part platen cover 1 be automatically lifted up by an amount suitable to the thickness (e.g., sheets or a book) of the original 4 with a capability to adjust the amount of ascent of the two-part platen cover 1 in incremental steps. If the operator selects a setting for copying several pages of an original document, the rear cover portion 12 would be automatically lifted up by 20 mm, for example. Even with this amount of ascent of the rear cover portion 12, the front cover portion 11 can be normally swung up and down so that the platen cover unit of the embodiment offers enhanced ease of copying operation and shortens time required for automatic descent and ascent of the two-part platen cover 1.

In another varied form of the embodiment, there may be provided a cover switch (sensor) 14 close to the hinge h for detecting the state of the front and rear cover portions 11, 12. In this variation of the embodiment, if the operator places an original 4 on the original 4 and flips down the front cover portion 11, the cover switch 14 senses that the front cover portion 11 has been set to the horizontal position (or closed). At this point, the controller 20 is activated and, as a consequence, the platen cover up/down motor 8 is first driven to automatically lower the front and rear cover portions 11, 12 together, and when scanning of the original 4 has finished, the platen cover up/down motor 8 is driven to automatically lift up the front and rear cover portions 11, 12. There may be made an arrangement to forcibly interrupt copying operation when the two-part platen cover 1 is not completely closed during the aforementioned image scanning process, because the original 4 can not be properly scanned due to the influence of extraneous light.

Fourth Embodiment

Figure 7:
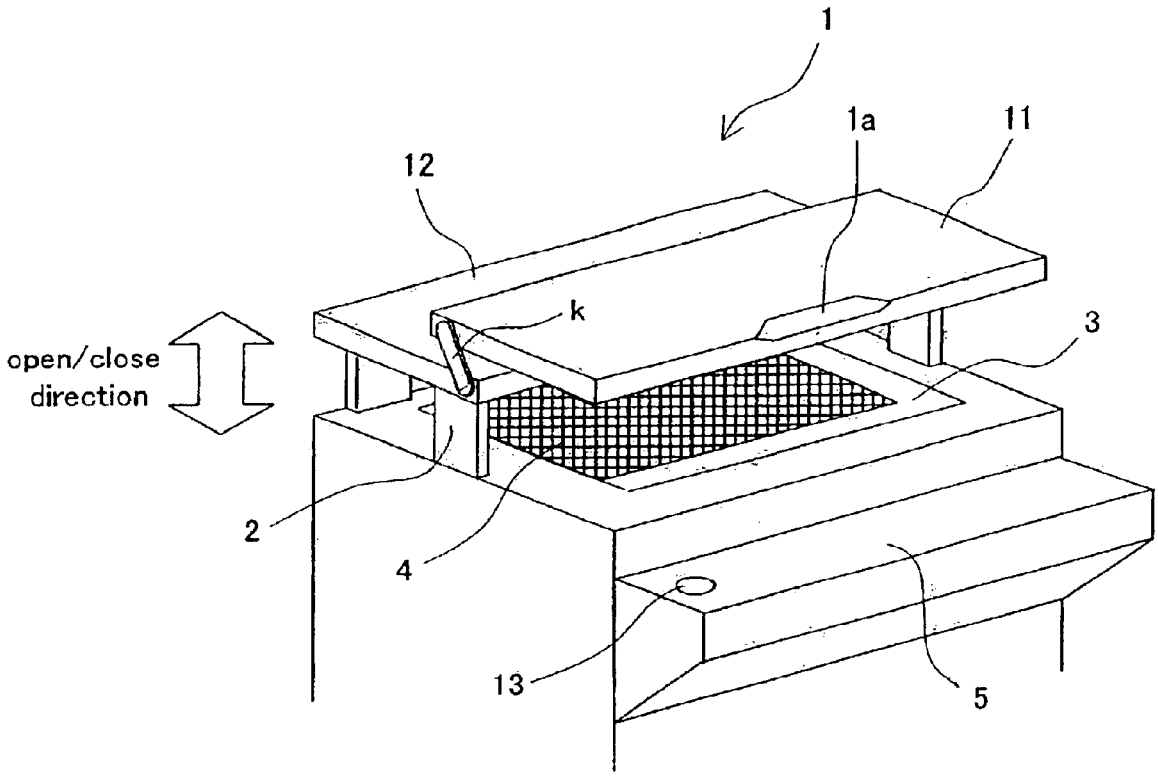
FIG. 7 is a perspective view mainly showing a platen cover unit according to a fourth embodiment of the invention.
Figure 8:
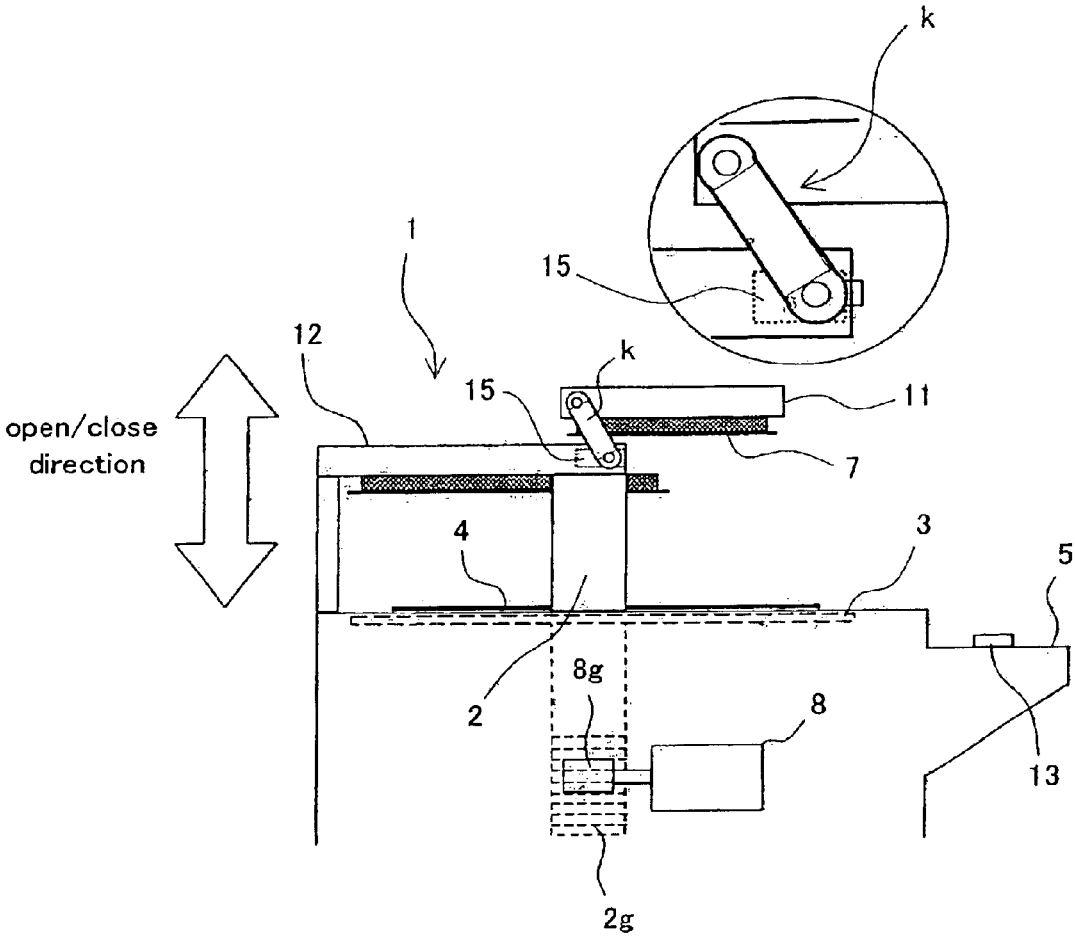
FIG. 8 is a side view mainly showing an automatic platen cover up/down mechanism of the platen cover unit of FIG. 7.

FIG. 7 is a perspective view mainly showing a platen cover unit of an image scanning device according to a fourth embodiment of the invention, and FIG. 8 is a side view mainly showing the platen cover unit of FIG. 7, in which elements identical or similar to those shown in FIGS. 2–3 are designated by the same reference numerals. This embodiment also employs a two-part platen cover structure. As shown in FIGS. 7–8, a two-part platen cover 1 is formed of a front cover portion 11 and a rear cover portion 12 which are joined together by link members k. The rear cover portion 12 is fixed to platen cover arms 2 and permanently held in a horizontal position, parallel to the platen glass 3, while the front cover portion 11 is made retractable obliquely upward with respect to the rear cover portion 12 to allow easy access to a front part of the platen glass 3 as illustrated.

There is provided a cover switch (sensor) 15 on a front end of the rear cover portion 12 (which comes in contact with a rear end of the front cover portion 11) for detecting the state of the front and rear cover portions 11, 12. The platen cover unit of this embodiment also employs the same support mechanism as depicted in FIG. 4 for supporting the platen cover arms 2.

In this embodiment, the operator places an original 4 on the platen glass 3 and moves the front cover portion 11 from its upper position down to its lower position so that its original holding surface becomes flush with that of the rear cover portion 12. At this point, the cover switch 15 senses that the front cover portion 11 has been closed, or lowered to the same level with the rear cover portion 12, and outputs a sensing signal to a controller 20. This sensing signal causes the controller 20 to drive the platen cover up/down motor 8 in a controlled manner. In one preferred form of the embodiment, the platen cover up/down motor 8 is first driven to lower the front and rear cover portions 11, 12 together, with their original holding surfaces made flush with each other in a horizontal plane, and upon completion of scanning of the original 4, the platen cover up/down motor 8 is driven to lift the front and rear cover portions 11, 12 up to their original positions in a fully automatic way according to a preset control program.

Fifth Embodiment

Figure 9:
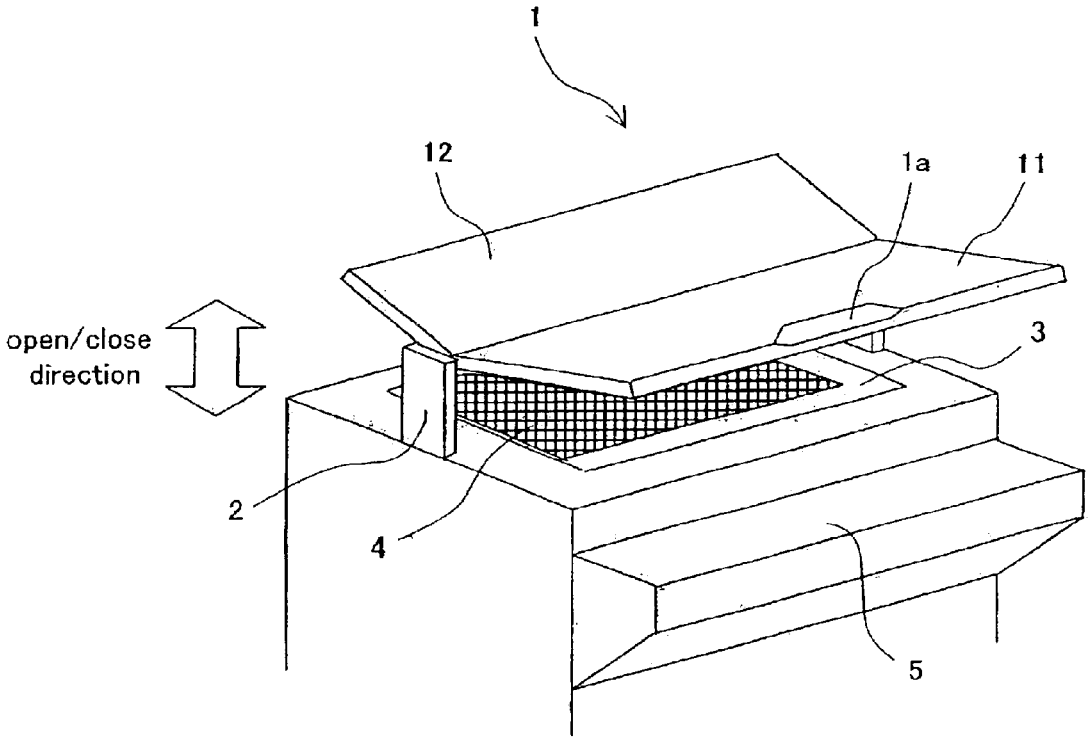
FIG. 9 is a perspective view mainly showing a platen cover unit according to a fifth embodiment of the invention.
Figure 10:
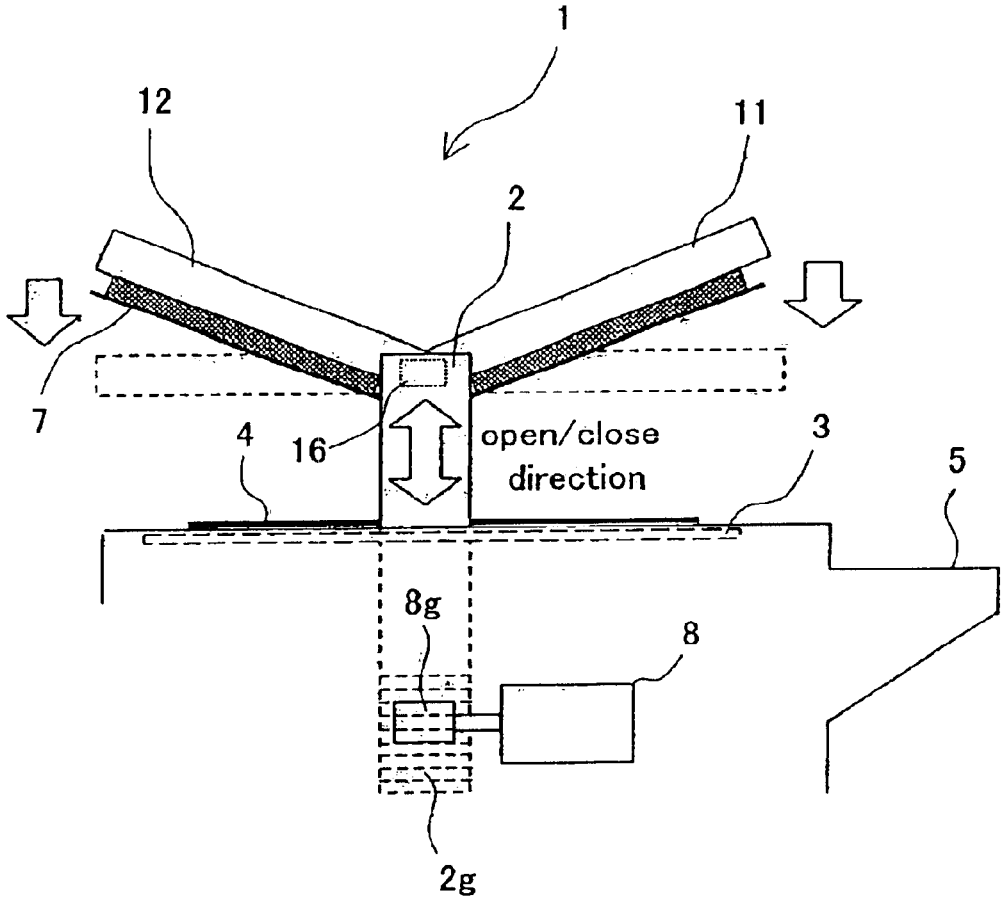
FIG. 10 is a side view mainly showing an automatic platen cover up/down mechanism of the platen cover unit of FIG. 9.

FIG. 9 is a perspective view mainly showing a platen cover unit of an image scanning device according to a fifth embodiment of the invention, and FIG. 10 is a side view mainly showing the platen cover unit of FIG. 9, in which elements identical or similar to those shown in FIGS. 2–3 are designated by the same reference numerals. This embodiment also employs a two-part platen cover structure, in which a two-part platen cover 1 is formed of a front cover portion 11 and a rear cover portion 12 which can be switched between a horizontal flat shape (closed state) and a V shape (open state) in interlocked action. More specifically, the front cover portion 11 and the rear cover portion 12 are joined to each other in an interlocked fashion by means of an interlock mechanism (not shown) provided at platen cover arms 2, so that the front and rear cover portions 11, 12 can be swung up and down together about their joint to turn them from the flat-shaped closed state to the V-shaped open state, and vice versa. The front and rear cover portions 11, 12 are set in the V-shaped open state under non-operating conditions.

If the operator places an original 4 on the platen glass 3 and swings down the front cover portion 11 to its horizontal position, the rear cover portion 12 interlocked with the front cover portion 11 is also brought to its horizontal position. At this point, a horizontal position sensor switch 16 provided at the joint of the front and rear cover portions 11, 12 detects that the they are now in the horizontal position, and a controller 20 is activated based on the result of detection by the horizontal position sensor switch 16. The controller 20 drives the platen cover up/down motor 8 in a controlled manner according to a preset control program. Specifically, the platen cover up/down motor 8 is first driven to automatically lower the front and rear cover portions 11, 12, and when scanning of the original 4 has finished, the platen cover up/down motor 8 is driven to automatically lift up the front and rear cover portions 11, 12 until they return to the V-shaped open state as illustrated. Since the two-part platen cover 1 descends in a horizontal position, it produces a stable wind pressure uniformly exerted from above on the entire surface of the original 4 without causing variations in the wind pressure, so that this embodiment also serves to prevent displacement of the original 4.

Sixth Embodiment

Figure 11:
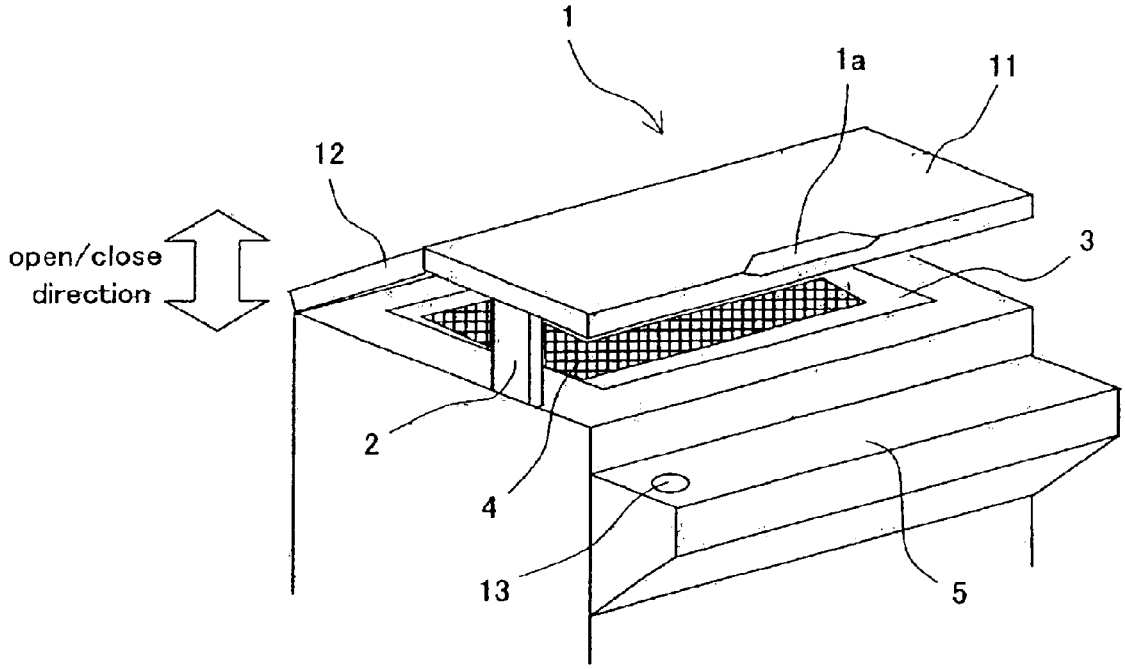
FIG. 11 is a perspective view mainly showing a platen cover unit according to a sixth embodiment of the invention.
Figure 12:
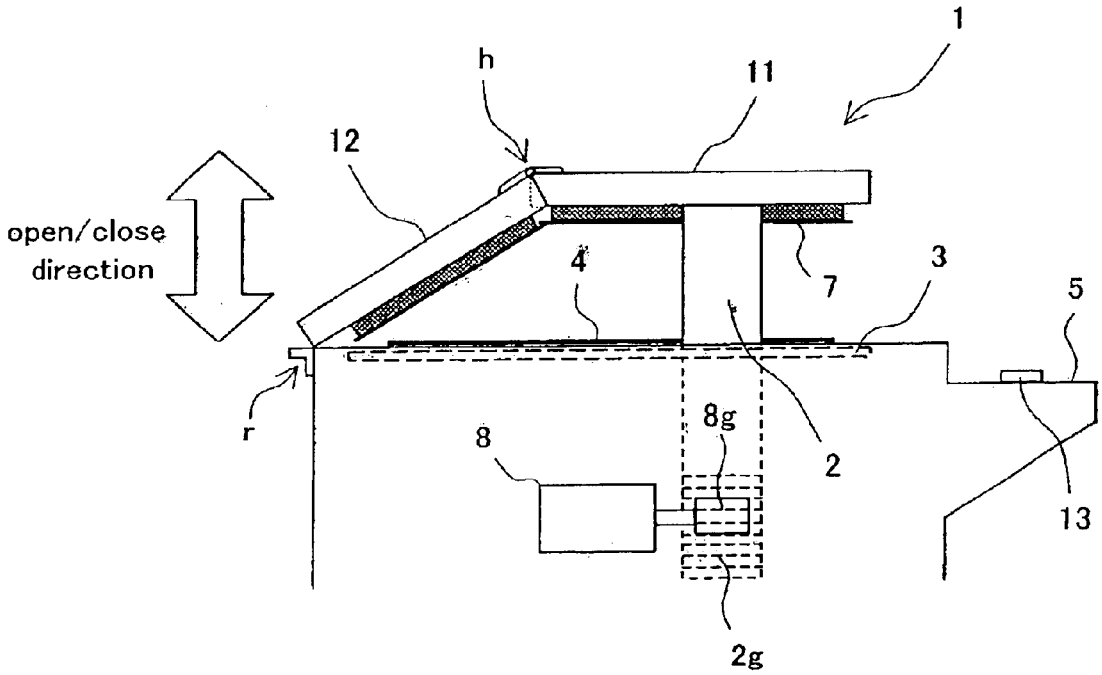
FIG. 12 is a side view mainly showing an automatic platen cover up/down mechanism of the platen cover unit of FIG. 11.

FIG. 11 is a perspective view mainly showing a platen cover unit of an image scanning device employing a two-part platen cover structure according to a sixth embodiment of the invention, and FIG. 12 is a side view mainly showing the platen cover unit of FIG. 11, in which elements identical or similar to those shown in FIGS. 2–3 are designated by the same reference numerals. A two-part platen cover 1 is formed of a front cover portion 11 and a rear cover portion 12, of which only the front cover portion 11 is always held in a horizontal position when moving up and down. As can be seen from FIGS. 11–12, the front cover portion 11 is fixed to left and right platen cover arms 2 and is always held in a horizontal position as it ascends and descends. The rear cover portion 12 is swingably joined to a rear edge of the front cover portion 11 by means of a hinge h and a rear edge of the rear cover portion 12 is slidably mounted on a support r provided at an upper rear edge of a housing of the image scanning device.

In one preferred form of the embodiment, the platen cover up/down motor 8 is actuated when the operator places an original 4 on the platen glass 3 and presses a platen cover up/down button 13. As a result, the platen cover up/down motor 8 automatically lowers the front cover portion 11 and the rear cover portion 12 together and the image scanning device scans the original 4. If the operator re-presses the platen cover up/down button 13 upon completion of scanning of the original 4, the platen cover up/down motor 8 automatically lifts the front cover portion 11 and the rear cover portion 12 up to their original positions. The image scanning device of this embodiment has a simple construction as its rear cover portion 12 is just connected to the front cover portion 11 by the hinge h.

Since the front cover portion 11 positioned parallel to the original 4 produces a wind pressure uniformly exerted on the entire surface of the original 4 without causing variations in the wind pressure, this embodiment also serves to prevent displacement of the original 4.

The image scanning device of this embodiment may also be constructed in such a way that its controller 20 is activated by pressing a START button (not shown) provided on the operator panel 5. Specifically, operation of the image scanning device of this construction would be such that, upon activation of the controller 20, the platen cover up/down motor 8 is driven to lower the front and rear cover portions 11, 12, the image scanning device scans the original 4, and the platen cover up/down motor 8 is driven to lift the front and rear cover portions 11, 12 up to their original positions in a fully automatic way according to a preset control program.

Seventh Embodiment

Figure 13:
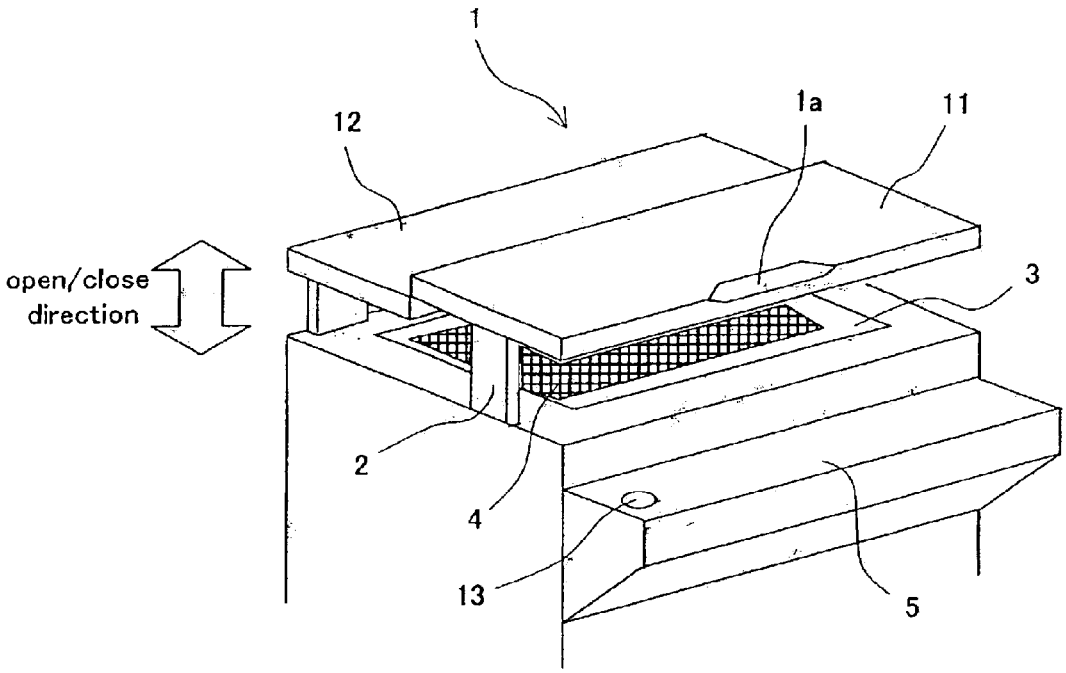
FIG. 13 is a perspective view mainly showing a platen cover unit according to a seventh embodiment of the invention.
Figure 14:
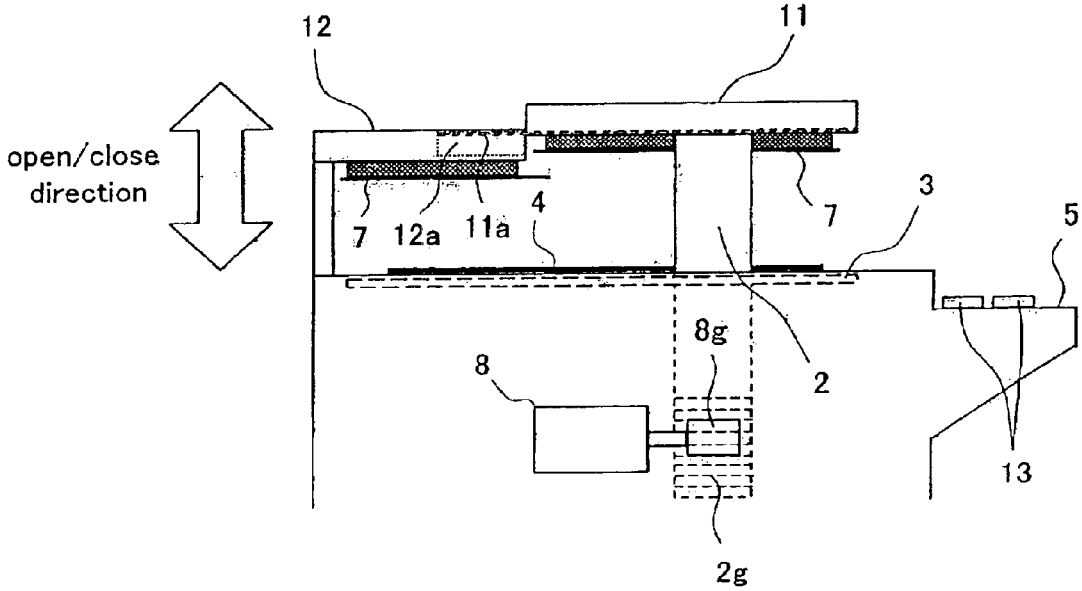
FIG. 14 is a side view mainly showing an automatic platen cover up/down mechanism of the platen cover unit of FIG. 13.

FIG. 13 is a perspective view mainly showing a platen cover unit of an image scanning device according to a seventh embodiment of the invention, and FIG. 14 is a side view mainly showing the platen cover unit of FIG. 13, in which elements identical or similar to those shown in FIGS. 2–3 are designated by the same reference numerals. This embodiment also employs a two-part platen cover structure, in which a two-part platen cover 1 is formed of a front cover portion 11 and a rear cover portion 12 which are joined to each other in a stepped form as illustrated. Specifically, a connecting part 11*a* (shown by broken lines) projecting rearward from a rear end of the front cover portion 11 fits in a cavity 12*a* formed in a front end of the rear cover portion 12 so that the rear cover portion 12 descends and ascends as the front cover portion 11 is lowered and lifted up in an interlocked fashion.

In one preferred form of the embodiment, the platen cover up/down motor 8 is actuated when the operator places an original 4 on the platen glass 3 and presses a platen cover up/down button 13. As a result, the platen cover up/down motor 8 automatically lowers the front cover portion 11 and the rear cover portion 12 together. Specifically, as the front cover portion 11 is lowered, the rear cover portion 12 descends by its own weight together with the front cover portion 11. Since the front and rear cover portions 11, 12 descend in their stepped form until they come into contact with the original 4, they press against the original 4 one by one. This construction of the two-part platen cover 1 serves to produce a smooth flow of air between the two-part platen cover 1 and the platen glass 3 and hold the original 4 in a reliable fashion, thereby preventing displacement of the original 4.

When both the front and rear cover portions 11, 12 finally hold the original 4, the connecting part 11*a* comes into contact with the bottom of the cavity 12*a* and original holding surfaces of the two cover portions 11, 12 become flush with each other in a horizontal plane, so that the cover portions 11, 12 hold the entire surface of the original 4 with a uniform pushing force in a stable fashion, enabling a high-precision image scanning operation. The construction of the platen cover unit may be such that, when the operator re-presses the platen cover up/down button 13 upon completion of the image scanning operation, the rear cover portion 12 is lifted together with the front cover portion 11 until they return to their original positions. Since the front and rear cover portions 11, 12 ascend in a stepped interlocked fashion when returning to their original positions, they produce little variations in wind pressure, so that the embodiment prevents displacement of the original 4 during cover lifting process as well.

The image scanning device of this embodiment may also be constructed in such a way that its controller 20 is activated by pressing a START button (not shown) provided on the operator panel 5. Specifically, operation of the image scanning device of this construction would be such that, upon activation of the controller 20, the platen cover up/down motor 8 is driven to lower the front and rear cover portions 11, 12, the image scanning device scans the original 4, and the platen cover up/down motor 8 is driven to lift the front and rear cover portions 11, 12 up to their original positions in a fully automatic way according to a preset control program.

Eighth Embodiment

Figure 15:
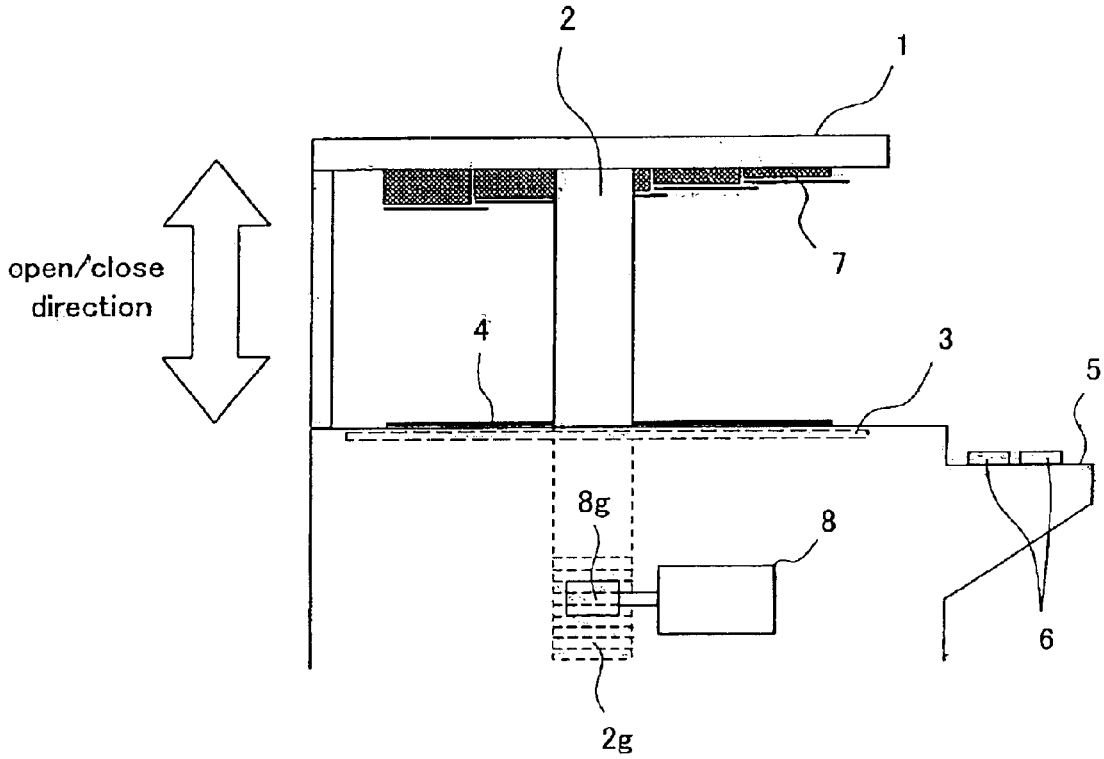
FIG. 15 is a side view mainly showing a platen cover unit having an automatic platen cover up/down mechanism according to an eighth embodiment of the invention.

FIG. 15 is a side view mainly showing a platen cover unit according to an eighth embodiment of the invention, in which elements identical or similar to those shown in FIGS. 2–3 are designated by the same reference numerals. The platen cover unit of this embodiment is characterized in that a mat 7 attached to a bottom surface of a horizontal platen cover 1 is formed by stacking a plurality of sheets in a steplike pattern. Specifically, the sheets are stacked in such a manner that the thickness of the mat 7 increases stepwise toward a rear end of the horizontal platen cover 1 as depicted in FIG. 15.

In one preferred form of the embodiment, the platen cover up/down motor 8 is actuated when the operator places an original 4 on the platen glass 3 with the original 4 aligned with a rear corner of the platen glass 3 and presses a DOWN button of a platen cover up/down control 6. As a result, the platen cover up/down motor 8 automatically lowers the horizontal platen cover 1 and the mat 7 formed of the multiple sheets stacked on the bottom surface of the horizontal platen cover 1 in a steplike pattern presses the original 4 in progressive steps from its rear edge.

Since part of the original 4 close to its rear edge is lightly pressed at first by the thickest portion of the mat 7, the original 4 is held in position. As the horizontal platen cover 1 descends further, the original 4 is pressed by progressively increasing areas of the mat 7. The entire surface of the original 4 is finally pressed by the mat 7 so that the original 4 is kept in the correct position in a stable fashion.

If the operator presses an UP button of the platen cover up/down control 6 upon completion of scanning of the original 4, the platen cover up/down motor 8 is reversely driven to automatically lift up the horizontal platen cover 1. Again, the mat 7 comes apart from the original 4 in a steplike fashion when the horizontal platen cover 1 ascends, so that the embodiment helps prevent displacement of the original 4 during cover lifting process as well.

The image scanning device of this embodiment may also be constructed in such a way that its controller 20 is activated by pressing a START button (not shown) provided on the operator panel 5. Specifically, operation of the image scanning device of this construction would be such that, upon activation of the controller 20, the platen cover up/down motor 8 is driven to lower the horizontal platen cover 1, the image scanning device scans the original 4, and the platen cover up/down motor 8 is driven to lift the horizontal platen cover 1 up to its original position fully automatically in a controlled manner.

Ninth Embodiment

Figure 16:
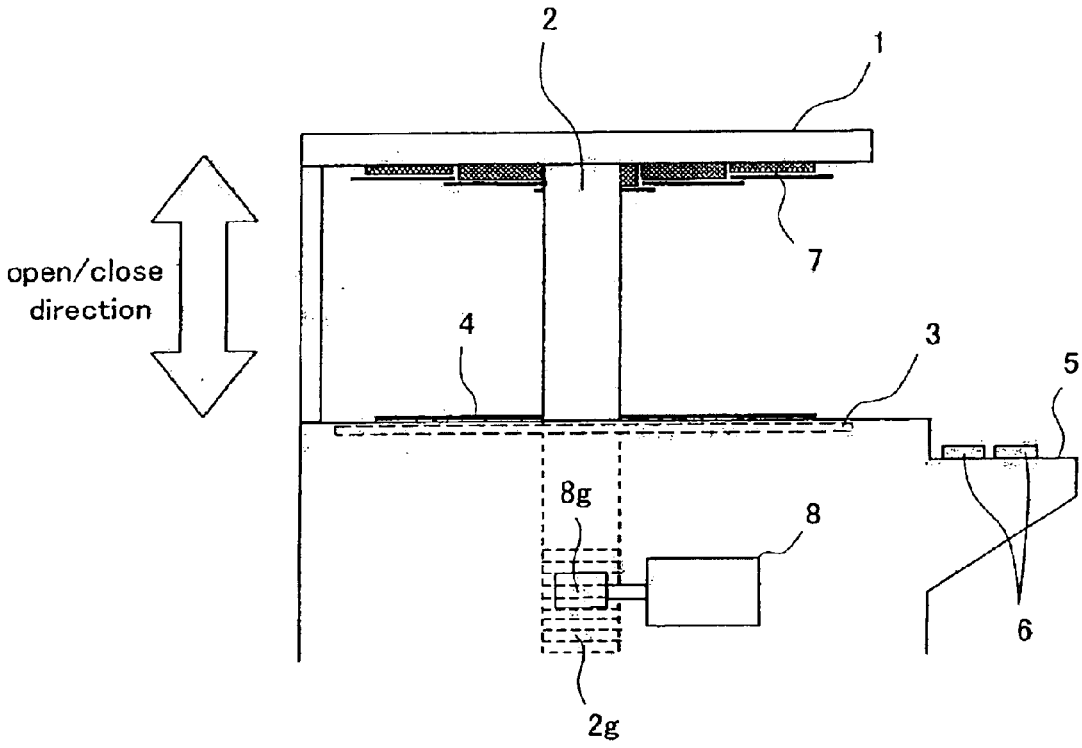
FIG. 16 is a side view mainly showing a platen cover unit having an automatic platen cover up/down mechanism according to a ninth embodiment of the invention.

FIG. 16 is a side view mainly showing a platen cover unit according to a ninth embodiment of the invention, in which elements identical or similar to those shown in FIGS. 2–3 are designated by the same reference numerals. The platen cover unit of this embodiment is characterized in that a mat 7 attached to a bottom surface of a horizontal platen cover 1 is formed by stacking a plurality of sheets in a steplike pattern in such a manner that the thickness of the mat 7 becomes largest at its middle portion between its front and rear ends as depicted in FIG. 16. Since an original 4 to be scanned is often center-aligned, or placed at a middle position between front and rear edges of an original loading area, the thickness of the mat 7 is made largest at its middle portion and progressively decreases toward the front and rear ends such that the mat 7 presses the original 4 in progressive steps from its middle portion toward both front and rear edges along a main scanning direction of the platen glass 3.

Since the original 4 is first pressed by the middle portion of the mat 7 and then by its front and rear portions in a steplike fashion with a uniform pushing force, it is possible to prevent displacement of the original 4 more efficiently in this embodiment. In addition, the individual portions of the mat 7 come apart from the original 4 in a steplike fashion when the horizontal platen cover 1 ascends upon completion of the image scanning operation, so that the embodiment helps prevent displacement of the original 4 during cover lifting process as well.

The image scanning device of this embodiment may also be constructed in such a way that its controller 20 is activated by pressing a START button (not shown) provided on the operator panel 5. Specifically, operation of the image scanning device of this construction would be such that, upon activation of the 20, the platen cover up/down motor 8 is driven to lower the horizontal platen cover 1, the image scanning device scans the original 4, and the platen cover up/down motor 8 is driven to lift the horizontal platen cover 1 up to its original position fully automatically in a controlled manner.

Additional Features and Advantageous Effects

As is apparent from the foregoing discussion, the invention provides the following advantageous effects.

According to one feature of the invention, the platen cover is held parallel to the platen glass when it is closed and, as a consequence, the flow of air is oriented in all directions without being concentrated in one direction. This would help prevent displacement of an original set on the platen glass. In addition, the invention offers improved operability since an operator needs to just reach the height of the platen cover at its vertically raised position when loading the original.

According to another feature of the invention, the platen cover is divided into at least two portions. This increases the degree of freedom in the design of a platen cover unit and makes it easier to construct an easy-to-open-and-close platen cover and achieve enhanced ease of operation.

In this construction, the divided portions of the platen cover are interconnected such that the individual portions can be closed and opened together, allowing easy closing and opening of the platen cover.

According to another feature of the invention, at least one of the divided portions of the platen cover is always held parallel to the platen glass, so that the original is first pressed by the portion of the platen cover which is always parallel to the platen glass and the flow of air is oriented in all directions without being concentrated in one direction. This serves to prevent displacement of the original placed in position on the platen glass. Also, this construction makes it possible to easily check alignment of the original and its displacement by lifting that portion of the platen cover which is not always held parallel to the platen glass.

In this construction, the operator can manually move up and down the portion of the platen cover which is not always held parallel to the platen glass, so that it is possible to easily align the original with a reference position by lifting that portion of the platen cover when loading the original on the platen glass. Furthermore, it is possible to easily check the status of alignment and displacement of the original by temporarily lifting the portion of the platen cover which is not always held parallel to the platen glass as stated above while keeping the original pressed against the platen glass with the other portion of the platen cover.

According to another feature of the invention, the divided portions of the platen cover are joined together in a stepped form, allowing easy closing and opening of the platen cover. Since the individual portions of the platen cover are held parallel to the platen glass while the platen cover is being closed, the flow of air is oriented in all directions without being concentrated in one direction. This serves to prevent displacement of the original placed in position on the platen glass.

According to another feature of the invention, at least one of the divided portions of the platen cover is lowered and lifted up in a position parallel to the platen glass and the other divided portion of the platen cover descends and ascends following the portion held parallel to the platen glass. This serves to simplify mechanical construction for lowering and lifting up the platen cover.

According to another feature of the invention, the divided portions of the platen cover are kept in the stepped form and parallel to the platen glass as they are lowered together. This construction produces a smooth flow of air and prevents displacement of the original. In addition, since the original is first pressed by the first descending portion of the platen cover and finally pressed by all the portions of the platen cover which have become flush with each other, the original can be held in position in a stable fashion.

According to still another feature of the invention, there is provided a sensor for detecting the open/closed state of the platen cover so that the result of detection by the sensor can be used to control the operation of an image scanning device, such as lowering and lifting of the platen cover. For example, there may be made an arrangement to forcibly interrupt copying operation when the platen cover is not completely closed, because the original can not be properly scanned due to the influence of extraneous light.

In this construction, a controller 20 may automatically control the platen cover according to the open/closed state of the platen cover detected by the sensor. The image scanning device may be constructed such that it automatically performs a sequence of image scanning operation. As an example, the image scanning device may perform the image scanning operation in such a manner that, when the operator places an original on the platen glass and closes the platen cover, the platen cover descends and presses the original onto the platen glass and the image scanning device scans the original in a fully automatic fashion. This arrangement would help improve ease of operation.

The image scanning device may be constructed such that a motor for lowering the platen cover is activated when the operator pushes down the platen cover or presses a platen cover down button or a copying start button. This construction makes it possible to automate the sequence of image scanning operation and thereby achieve enhanced ease of operation.

Alternatively, the image scanning device may be constructed such that a motor for lifting up the platen cover is activated when the operator forces the platen cover upward or presses a platen cover up button or upon completion of copying operation. This construction also makes it possible to automate the sequence of image scanning operation and thereby achieve enhanced ease of operation.

According to yet another feature of the invention, a mat formed by stacking a plurality of elastic sheets in a steplike fashion is attached to a bottom surface of the platen cover. In this construction, the original is first pressed by the thickest portion of the mat and then by other portions of the mat. This construction serves to produce a smooth flow of air between the platen cover and the platen glass and hold the original in a reliable fashion, thereby preventing displacement of the original.

The elastic sheets of the mat may be stacked in such a manner that the thickness of the mat increases stepwise toward a rear end of the platen cover. Particularly when the image scanning device is of a type in which the original is to be aligned with a rear corner of the platen glass, the platen cover produces a smooth flow of air and presses the original in progressive steps from its rear edge in a stable fashion. This serves to prevent displacement of the original.

Alternatively, the elastic sheets of the mat may be stacked in such a manner that the thickness of the mat becomes largest at its middle portion between its front and rear ends. Particularly when the image scanning device is of a type in which the original is to be center-aligned, or aligned with a reference mark located between front and rear edges of an original loading area, the platen cover produces a smooth flow of air and presses the original in progressive steps from its middle portion toward both front and rear edges in a stable fashion. This serves to prevent displacement of the original.

What is claimed is:

1. A platen cover open/close mechanism for an image scanning device, said platen cover open/close mechanism comprising:

a platen cover for pressing an original placed on an original loading plate thereagainst;

a platen cover support supporting the platen cover in such a manner that the platen cover can be lowered onto and lifted up from the original loading plate; and a cover lowering mechanism for lowering the platen cover while holding said platen cover in a horizontal position with the aid of the platen cover support.

2. The platen cover open/close mechanism according to claim 1, wherein the platen cover is always kept parallel to the original loading plate.

3. The platen cover open/close mechanism according to claim 1 further comprising a sensor for detecting the open/closed state of said divided portions of the platen cover.

4. The platen cover open/close mechanism according to claim 3 further comprising a controller which outputs a control command to a platen cover moving device for automatically moving the platen cover according to the result of detection by said sensor.

5. The platen cover open/close mechanism according to claim 4, wherein the controller is activated when an operator pushes down the platen cover or presses a platen cover down button or a copying start button, and outputs the control command to the platen cover moving device for lowering the platen cover.

* * * * *